US010995470B2

(12) United States Patent
Vail et al.

(10) Patent No.: US 10,995,470 B2
(45) Date of Patent: May 4, 2021

(54) SERVICE PIN ASSEMBLY FOR A MACHINE

(71) Applicant: Caterpillar Underground Mining Pty. Ltd., South Burnie (AU)

(72) Inventors: Adam Richard Vail, Aurora, IL (US); Jeffery Mohamed Othman, Naperville, IL (US); Riley Albers, Sugar Grove, IL (US); Kamesh Gopal, Chennai (IN)

(73) Assignee: Caterpillar Underground Mining Pty. Ltd., Tasmania (AU)

( * ) Notice: Subject to any disclaimer, the term of this patent is extended or adjusted under 35 U.S.C. 154(b) by 262 days.

(21) Appl. No.: 16/026,216

(22) Filed: Jul. 3, 2018

(65) Prior Publication Data

US 2020/0011023 A1 Jan. 9, 2020

(51) Int. Cl.
*E02F 3/38* (2006.01)

(52) U.S. Cl.
CPC ..... *E02F 3/388* (2013.01)

(58) Field of Classification Search
CPC ..... B60D 1/66; E02F 3/388
USPC ..... 292/192, 341.17; 403/95; 414/694
See application file for complete search history.

(56) References Cited

U.S. PATENT DOCUMENTS

| | | | | |
|---|---|---|---|---|
| 2,372,705 | A * | 4/1945 | Bicker | B60S 9/22 254/427 |
| 4,355,944 | A * | 10/1982 | Lorenc | E02F 3/388 298/17 B |
| 4,388,038 | A * | 6/1983 | Freitag | E02F 3/3405 298/17 B |
| 4,735,547 | A * | 4/1988 | Wagner | E02F 3/32 172/413 |
| 6,302,381 | B1 * | 10/2001 | Roll | B60D 1/66 254/418 |
| 8,684,656 | B2 | 4/2014 | Hilsden et al. | |
| 9,062,435 | B2 | 6/2015 | Hylen | |
| 9,719,228 | B2 | 8/2017 | Kumbhar et al. | |
| 2009/0127218 | A1 * | 5/2009 | Hylen | E02F 9/24 212/292 |
| 2016/0281321 | A1 * | 9/2016 | Kumbhar | E02F 3/388 |
| 2017/0130419 | A1 | 5/2017 | Vail et al. | |

* cited by examiner

*Primary Examiner* — Saul Rodriguez
*Assistant Examiner* — Brendan P Tighe
(74) *Attorney, Agent, or Firm* — Obhan & Associates

(57) ABSTRACT

A service pin assembly for a machine includes a service pin and a tray for retaining the service pin. The tray is attachable to a frame of the machine, and is pivotable relative to the frame between a first position and a second position. In the first position, the tray facilitates a storage of the service pin with the machine. In the second position, the tray facilitates an engagement of the service pin with a lift arm of the machine and the frame to restrict a relative movement between the frame and the lift arm.

20 Claims, 11 Drawing Sheets

SERVICE PIN ASSEMBLY FOR A MACHINE

TECHNICAL FIELD

The present disclosure generally relates to a machine having a frame and a lift arm, and more particularly, to a service pin assembly for the machine that engages the frame with the lift arm to restrict a relative movement between the frame and the lift arm.

BACKGROUND

Machines, such as earth moving machines, construction machines, mining machines, generally include a lift arm and a work implement, such as a bucket that help the machine perform certain earth moving operations. Such work implements may be coupled to the lift arm, and may be raised and lowered by moving the lift arm, during material loading and transferring operations, for example.

For desired operational performance, regular servicing or maintenance of the machine may be performed. For inspection or maintenance of the lift arm, and of the components, such as actuators (such as fluid cylinders) associated with lift arm, the lift arms are generally maintained in a raised position. One way of holding the lift arm in the raised position is to extend the lift arm cylinder by operating a lever in an operator cabin and hold the lever in that position. However, the lift arm may be brought down if the actuators malfunction, or if a person unduly or unknowingly moves a lever associated with the operation of the actuators.

SUMMARY

In one aspect, the disclosure is directed towards a service pin assembly for a machine. The service pin assembly includes a service pin and a tray for retaining the service pin. The tray is attachable to a frame of the machine, and is pivotable relative to the frame between a first position and a second position. In the first position, the tray facilitates a storage of the service pin with the machine. In the second position, the tray facilitates an engagement of the service pin with a lift arm of the machine and the frame to restrict a relative movement between the frame and the lift arm.

In another aspect, the disclosure relates to a machine. The machine includes a frame, a lift arm, a service pin, and a tray. The lift arm is coupled to the frame and is configured to pivot relative to the frame. The service pin is configured to engage the frame with the lift arm to restrict a relative movement between the frame and the lift arm. Further, the tray retains the service pin, and is coupled to the frame of the machine. The tray is pivotable relative to the frame between a first position and a second position. In the first position, the tray facilitates a storage of the service pin with the machine. In the second position, the tray facilitates an engagement of the service pin with the lift arm of the machine and the frame.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
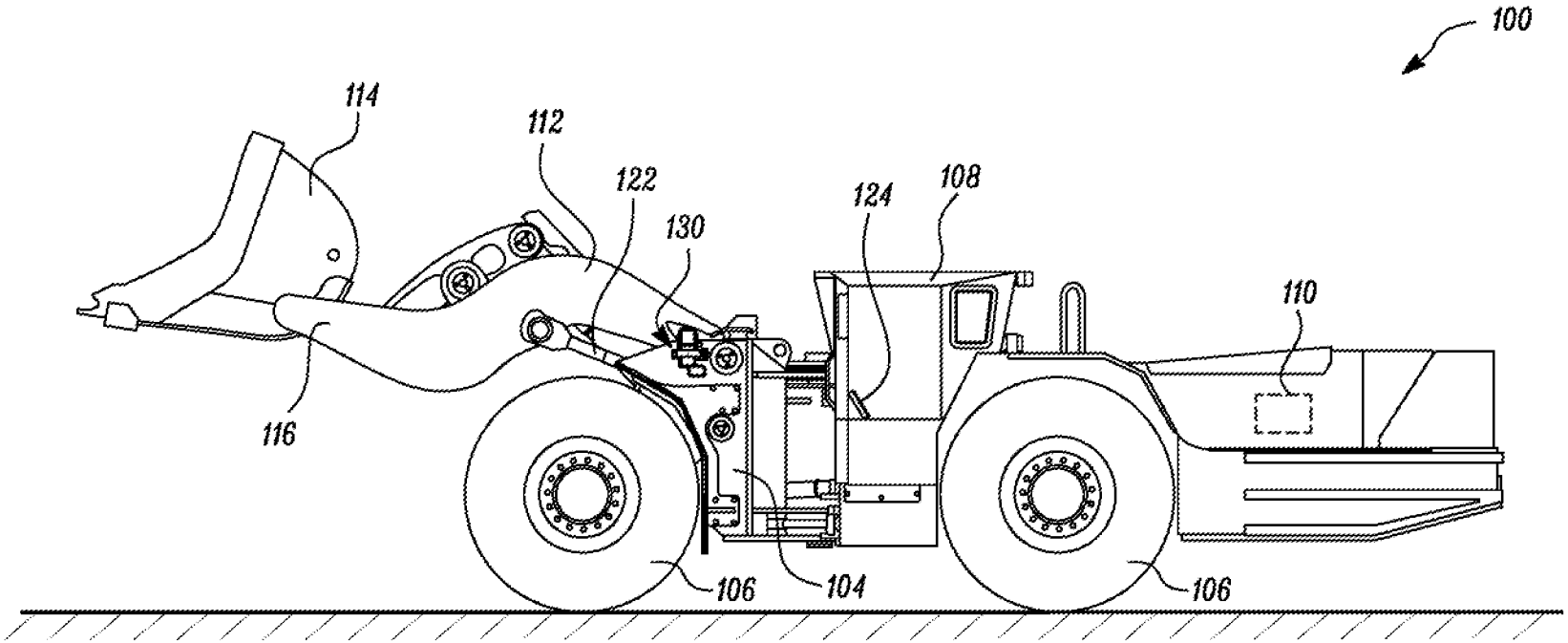
FIG. 1 is an exemplary machine including an exemplary service pin assembly, in accordance with an embodiment of the present disclosure.
Figure 2:
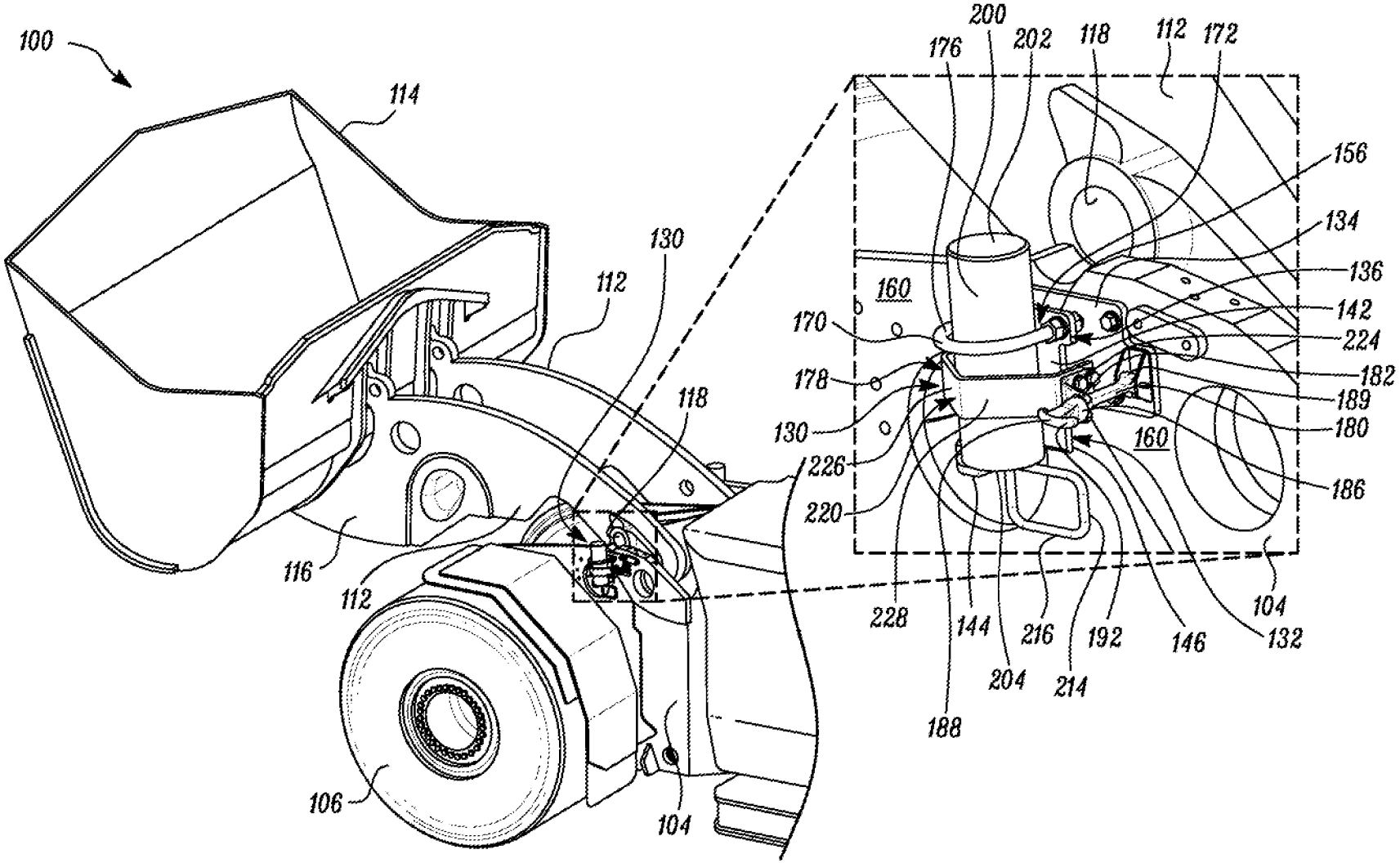
FIG. 2 is a partial perspective view of the machine depicting a lift arm of the machine and the service pin assembly having a tray disposed in a first position, in accordance with an embodiment of the present disclosure.

FIG. 1 illustrates an exemplary machine 100 that may incorporate a service pin assembly 130 (shown in FIG. 2). The machine 100 may be configured to perform work associated with a particular industry such as, for example, underground mining, open pit mining, construction, etc. For example, the machine 100 may be an underground mining loader (shown in FIG. 1), a load haul dump loader, a wheel loader, a skid steer loader, or any other machine.

Referring to FIG. 1 and FIG. 2, the machine 100 may include a frame 104 which supports traction devices 106, a cab 108, and a power source 110, such as a hydrostatic drive or an engine, and the like. The machine 100 may further include one or more lift arms 112 that are movably or pivotably coupled to the frame 104 at one end. An implement such as bucket 114 is pivotally attached to working end 116 of the lift arms 112. The bucket 114 may be attached to the lift arms 112 by any suitable coupling means such as a coupler, pin, latches, or any other mechanism generally known in the art. One or both of the lift arms 112 may include a hole 118 (shown in FIG. 2).

The machine 100 may also be provided with one or more lift arm actuators 122 that operatively couples the lift arms 112 to the frame 104. The lift arm actuators 122 are extended or retracted to raise or lower the lift arms 112. Further, the cab 108 may house an operator interface 124 through which an operator may be able to operate any one or more of the traction devices 106, the power source 110, the lift arms 112, the bucket 114, and the like.

The machine 100 further includes a service pin assembly 130 for engaging the lift arm 112 with the frame 104 to prevent a pivotal movement of the lift arm 112 relative to the frame 104. Referring to FIG. 2, the service pin assembly 130 includes a service pin 200 and a bracket assembly 132 configured to retain the service pin 200. The bracket assembly 132 facilitates a storage of the service pin 200 with the frame 104, and an insertion of the service pin 200 within the hole 118 for engagement of service pin 200 with the lift arm 112. The service pin 200 is configured to engage the frame 104 with the lift arm 112 to restrict a relative movement between the frame 104 and the lift arm 112.

Figure 6:
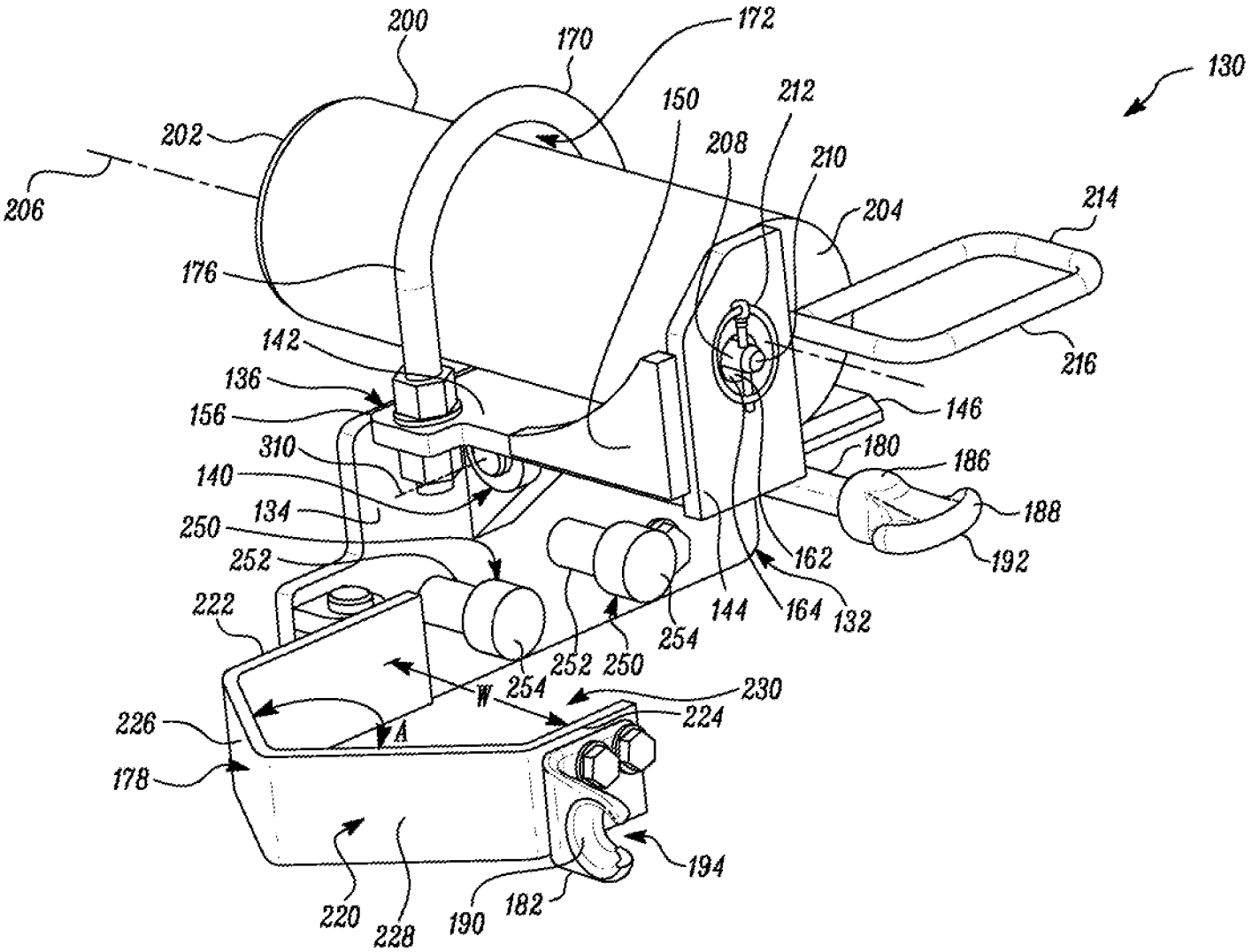
FIG. 6 is a perspective view of the service pin assembly having the tray disposed in a second position, in accordance with an embodiment of the present disclosure.

Referring to FIGS. 2 to 5, the bracket assembly 132 may include a bracket 134 fixedly attached to the frame 104 (thus coupling the bracket assembly 132 to the frame 104) and a tray 136 pivotably coupled to the bracket 134 via a hinge 140 (shown in FIG. 6). In an embodiment, the pivotable coupling or attachment between the tray 136 and the bracket 134 (or the frame 104) may be facilitated around an axis 310 (see FIG. 6). Axis 310 may be defined by the hinge 140, and thus, the axis 310 may be interchangeably referred to as hinge axis 310. The tray 136 may pivot between a first position (shown in FIG. 2 and FIG. 8) and a second position (shown in FIG. 9) relative to the frame 104. In the first position, the tray 136 facilitates the storage of the service pin 200, while in the second position, the tray 136 facilitates an engagement of the service pin 200 with the lift arm 112 and the frame 104 to prevent or restrict a pivotal movement of the lift arm 112 relative to the frame 104. The tray 136 facilitates the engagement of the service pin 200 by aligning the service pin 200 with the hole 118 formed in the lift arm 112 in the second position.

The tray 136 may include a base 142 pivotably coupled to the bracket 134 via the hinge 140, and a wall 144 coupled to a first end 146 (shown in FIG. 5) of the base 142. The base 142 may support the service pin 200 in the second position of the tray 136, while the wall 144 may support the service pin 200 in the first position of the tray 136. The tray 136 may include a side plate 150 (best shown in FIG. 3 and FIG. 5) that may connect an edge of the wall 144 to an edge of the base 142. The side plate 150 may provide additional support to the service pin 200. The hinge 140 may be attached to the base 142 proximate to a second end 156 of the base 142. The base 142 may extend substantially perpendicular to the wall 144, and may be disposed substantially parallel to a surface 160 (shown in FIG. 2) of the frame 104 when the tray 136 is in the first position. In the first position of the tray 136, the wall 144 may be substantially perpendicular to the surface 160, while in the second position of the tray 136, the wall 144 may be disposed substantially parallel to the surface 160. Further, the wall 144 may include a coupling structure 162 (shown in FIG. 6) to engage/couple and retain the service pin 200 with the tray 136, in the first position of the tray 136. In one example, the coupling structure 162 includes an opening 164 formed in the wall of the tray 136. Although the coupling structure 162 is contemplated as the opening 164, it may be appreciated the coupling structure 162 may be any other structure, such as, but not limited to, a protrusion extending from the wall 144 towards the second end 156 of the base 142, or any other suitable structure configured to facilitate an engagement of the service pin 200 with the wall 144 or the tray 136.

The service pin assembly 130 may include a retention structure 170 coupled to the tray 136 to facilitate a retention of the service pin 200 with the tray 136. In one example, and as shown, the retention structure 170 includes a U-shaped profile defining an opening 172 with the tray 136 (i.e., with the base 142 of the tray 136) for receiving the service pin 200. In an exemplary embodiment, the retention structure 170 may be disposed proximate to the second end 156 of the base 142. In some embodiments, the retention structure 170 may include a flexible member that is bent and coupled to the base 142 to define the U-shaped profile and the opening 172 with the base 142. Alternatively, the retention structure 170 may include a rigid member defining the U-shaped profile. In certain implementations, the retention structure 170 may be a U-bolt 176 fastened to the base 142.

The service pin 200 may include a shape and profile that may be compliant for passage through the opening 172 formed by the retention structure 170 and the base 142. For example, the service pin 200 may include a cylindrical shape having a first axial end face 202, a second axial end face 204, and a central longitudinal axis 206 passing through both the first axial end face and 202 the second axial end face 204. The service pin 200 may include a fastening structure 208 (best shown in FIG. 5 and FIG. 6) disposed at the second axial end face 204. The fastening structure 208 may be engaged with the coupling structure 162 for attaching and retaining the service pin 200 with the tray 136. In some embodiments, the fastening structure 208 includes a stud 210 that may be configured to be received into and extended through the opening 164, and be retained thereof to the tray 136 (i.e., the wall 144 of the tray 136) by a clip pin 212. As shown, the stud 210 may extend outwardly from the second axial end face 204 of the service pin 200. The stud 210 may extend outwardly in a direction substantially parallel to the central longitudinal axis 206 of the service pin 200, and may be disposed at an offset from the central longitudinal axis 206. Although the fastening structure 208 is contemplated as the stud 210, it may be appreciated the fastening structure 208 may be any other structure complimentary to the coupling structure 162 configured to facilitate an engagement of the service pin 200 with the wall 144 or the tray 136.

The service pin 200 is configured to slidably move relative to the tray 136 between a stored position and an extended position. In the first position of the tray 136, the service pin 200 is disposed at the stored position (as shown in FIG. 2) and is attached with or coupled to the tray 136 due to the engagement of the coupling structure 162 and the fastening structure 208. In the stored position of the service pin 200, the second axial end face 204 may be abutted to rest against the wall 144 of the tray 136. In the second position of the tray 136, the service pin 200 may be dislodged from the wall 144 (i.e., by removing the clip pin 212 and freeing the stud 210 to clear and move out of the opening 164 of the wall 144), and may be slidably moved from the stored position to the extended position by sliding the service pin 200 relative to the tray 136 (i.e., the base 142 of the tray 136). In the extended position of the service pin 200, the service pin 200 is partly inserted into the hole 118 of the lift arm 112 for engaging the service pin 136 with the lift arm 112 and the frame 104.

Figure 11:
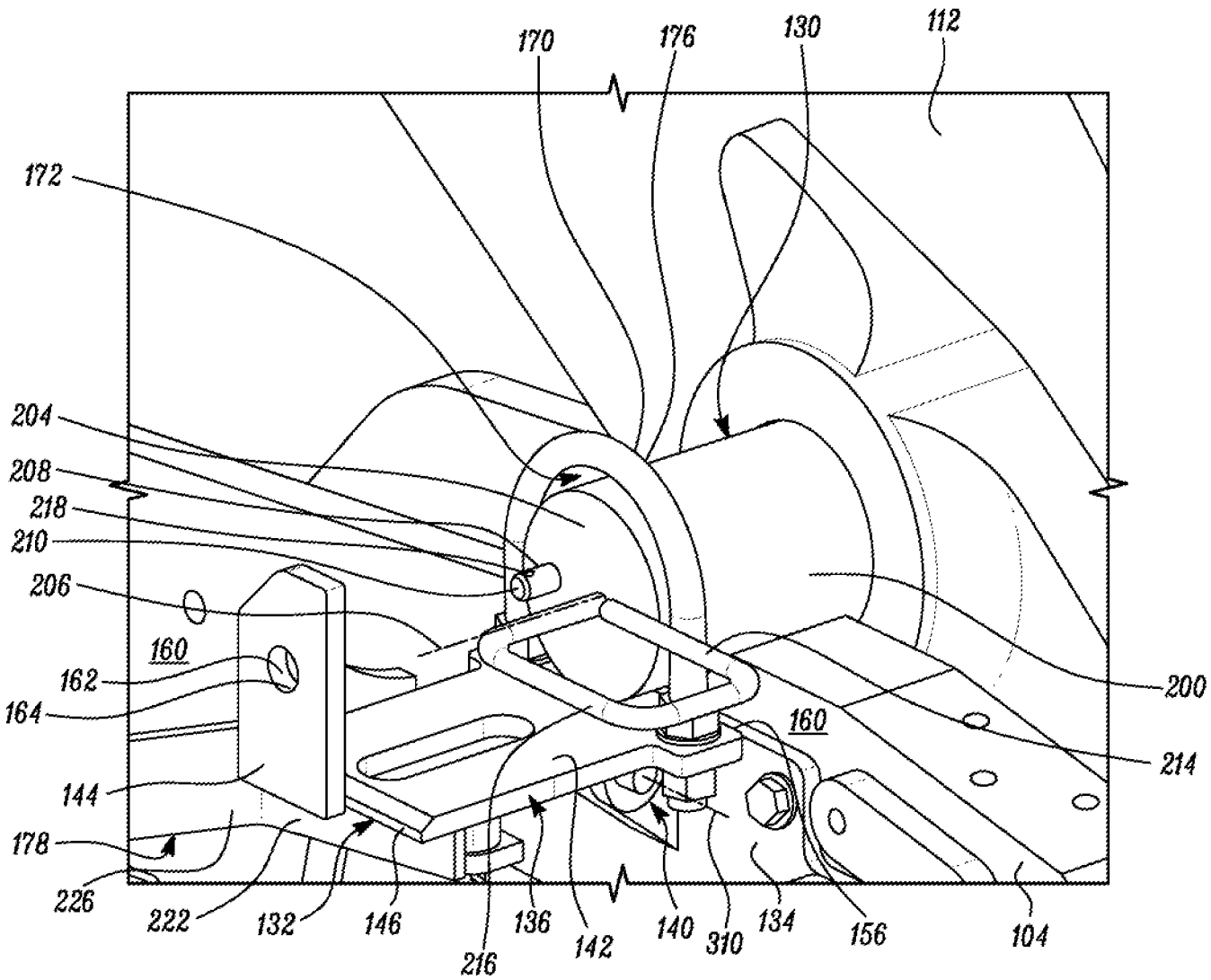

In some embodiments, the service pin 200 may include a stopper 214 configured to abut the frame 104 or the retention structure 170 to stop a sliding movement of the service pin 200 towards the frame 104. For example, the stopper 214 may stop the sliding movement of the service pin 200 into the hole 118 beyond a certain extent. Therefore, an abutment of the stopper 214 with the retention structure 170 or the frame 104 may indicate the in-part insertion of the service pin 200 into the hole 118 and a coupling/engagement of the service pin 200 with the lift arm 112. As shown in FIG. 6 and FIG. 11, the stopper 214 may abut against the retention structure 170 to stop the sliding movement of the service pin 200 towards the frame 104. In an embodiment, the stopper 214 may be disposed at the second axial end face 204 of the service pin 200, and may include a handle 216 as shown. The handle 216 may enable an operator to manipulate the service pin 200 manually, so as to slide the service pin 200 in and out of the hole 118.

Figure 7:
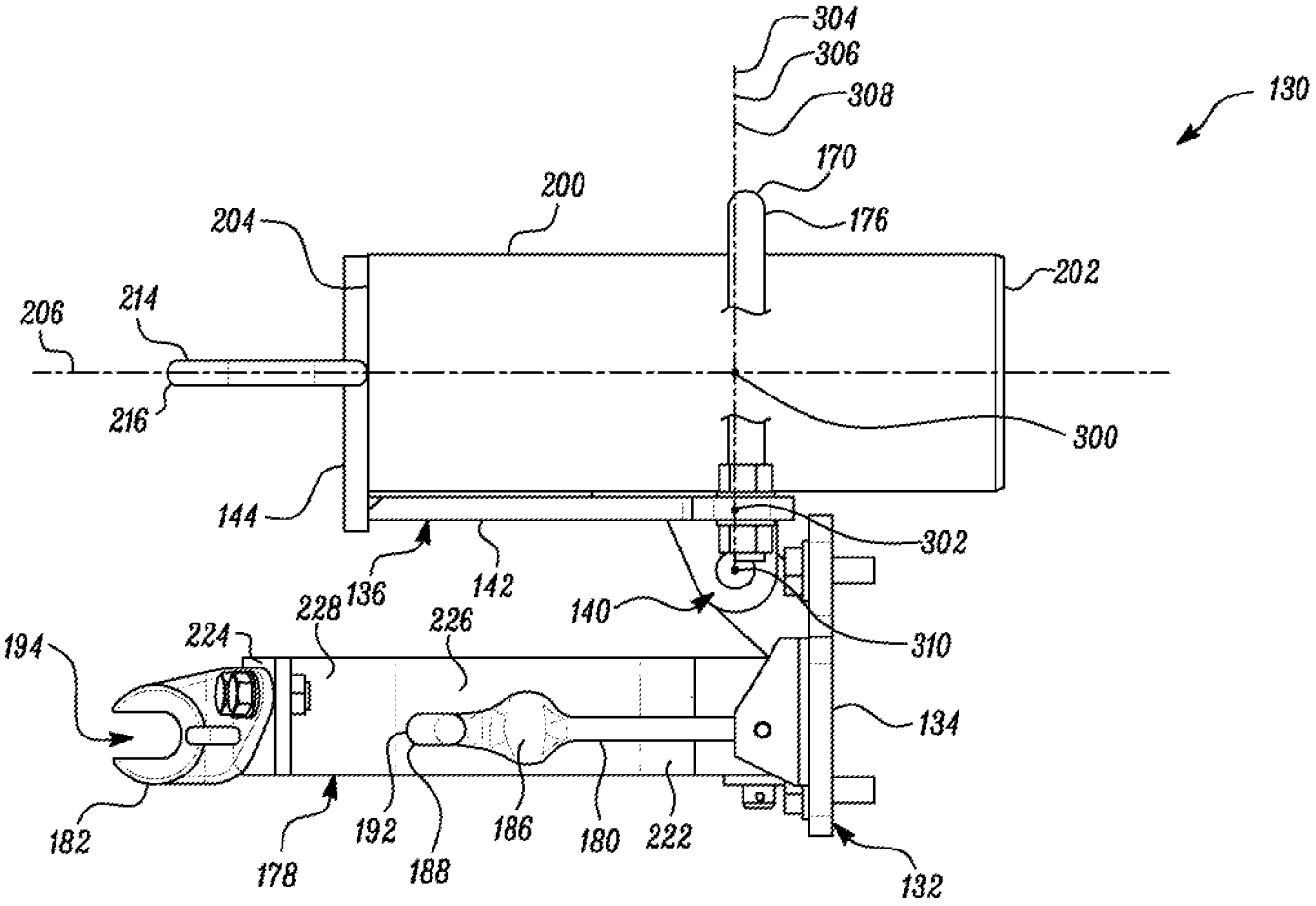
FIG. 7 is a side view of the service pin assembly having the tray disposed in a second position, in accordance with an embodiment of the present disclosure.

Referring to FIG. 7, and according to an embodiment, the service pin 200 may define a first center of gravity 300, and a first axis 304 passing through the first center of gravity 300. The first axis 304 may be perpendicular to the central longitudinal axis 206, and may be parallel to the first axial end face 202 (and/or the second axial end face 204). Further, the tray 136 may define a second center of gravity 302, and a second axis 306 passing through the second center of gravity 302. The second axis 306 may be parallel to the wall 144 of the tray 136 and perpendicular to the base 142 of the tray 136. Further, the hinge 140 may define a third axis 308 that may be passing through and be perpendicular to the hinge axis 310 (see FIG. 6). In one example, the third axis 308 may be parallel to the surface 160 of the frame 104.

In certain implementations, each of the first center of gravity 300 and the second center of gravity 302 is proximal to the hinge 140 relative to the handle 216 or the first end 146 of the base 142, when the tray 136 is disposed in the first position, or when the tray 136 is disposed in the second position and the service pin 200 is disposed at the stored position. In some embodiments, the first center of gravity 300 and the second center of gravity 302 are aligned with each other and may be disposed vertically above the hinge 140 (as shown in FIG. 7). In such a case, the first axis 304 and the second axis 306 are each aligned with the third axis 308. Accordingly, in some cases, the center of gravity 300 of the service pin 200 and the center of gravity 302 of the tray 136 may be disposed above the hinge 140, in the second position of the tray 136, with the service pin 200 being disposed at the stored position.

The service pin assembly 130 may include a strap 178 pivotably coupled to the bracket 134 (or to the frame 104), and a latch 180 configured to engage with the strap 178 to retain the tray 136 in the first position. The strap 178 is configured to pivot between a locked position and an unlocked position relative to the bracket 134. In the locked position, the latch 180 is engaged with the strap 178 to hold the service pin 200 and retain the tray 136 in the first position. In the locked position, the strap 178 may enwrap the service pin 200 to hold the service pin 200. In an embodiment, the strap 178 may include a substantially V shaped profile that caters to suitably encompass and retain both the service pin 200 and the tray 136. In the locked position, the strap 178 reduces an oscillating movement of the tray 136 and the service pin 200, relative to the frame 104. The strap 178 may include a hook portion 182 (best shown in FIG. 6) that may be engaged with the latch 180 in the locked position of the strap 178. In the unlocked position, the strap 178 is in disengagement from the latch 180, and thereby facilitates a movement of the tray 136 from the first position to the second position. The strap 178 may be made of steel or any other suitable material known in the art.

Figure 3:
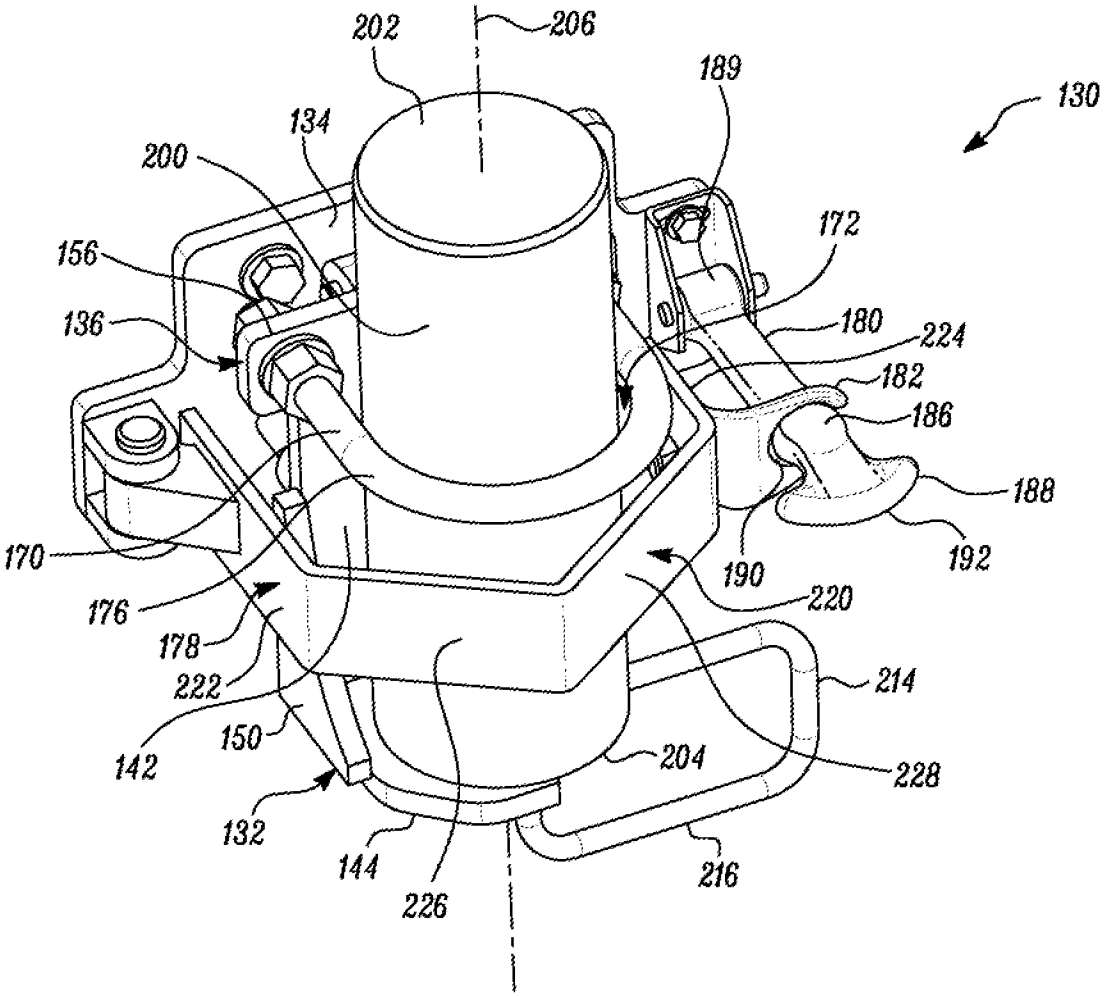
FIG. 3 is a top perspective view of the service pin assembly having the tray disposed in the first position, in accordance with an embodiment of the present disclosure.
Figure 4:
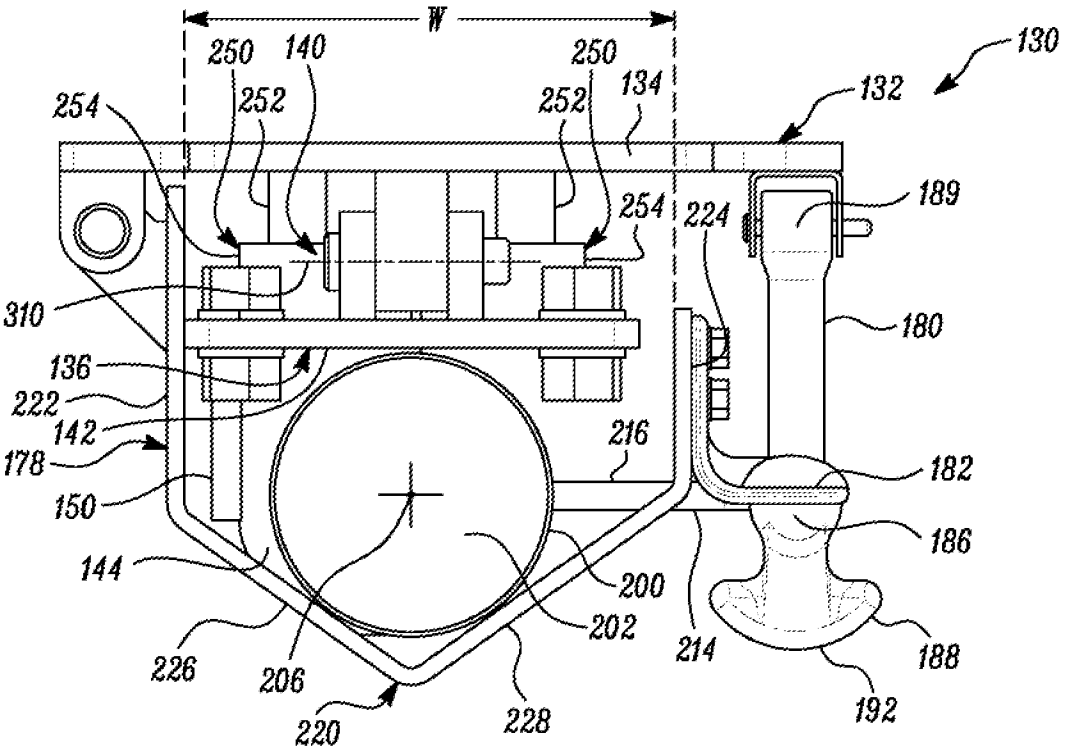
FIG. 4 is a top view of the service pin assembly shown in FIG. 3 with a retention structure removed, in accordance with an embodiment of the present disclosure.
Figure 5:
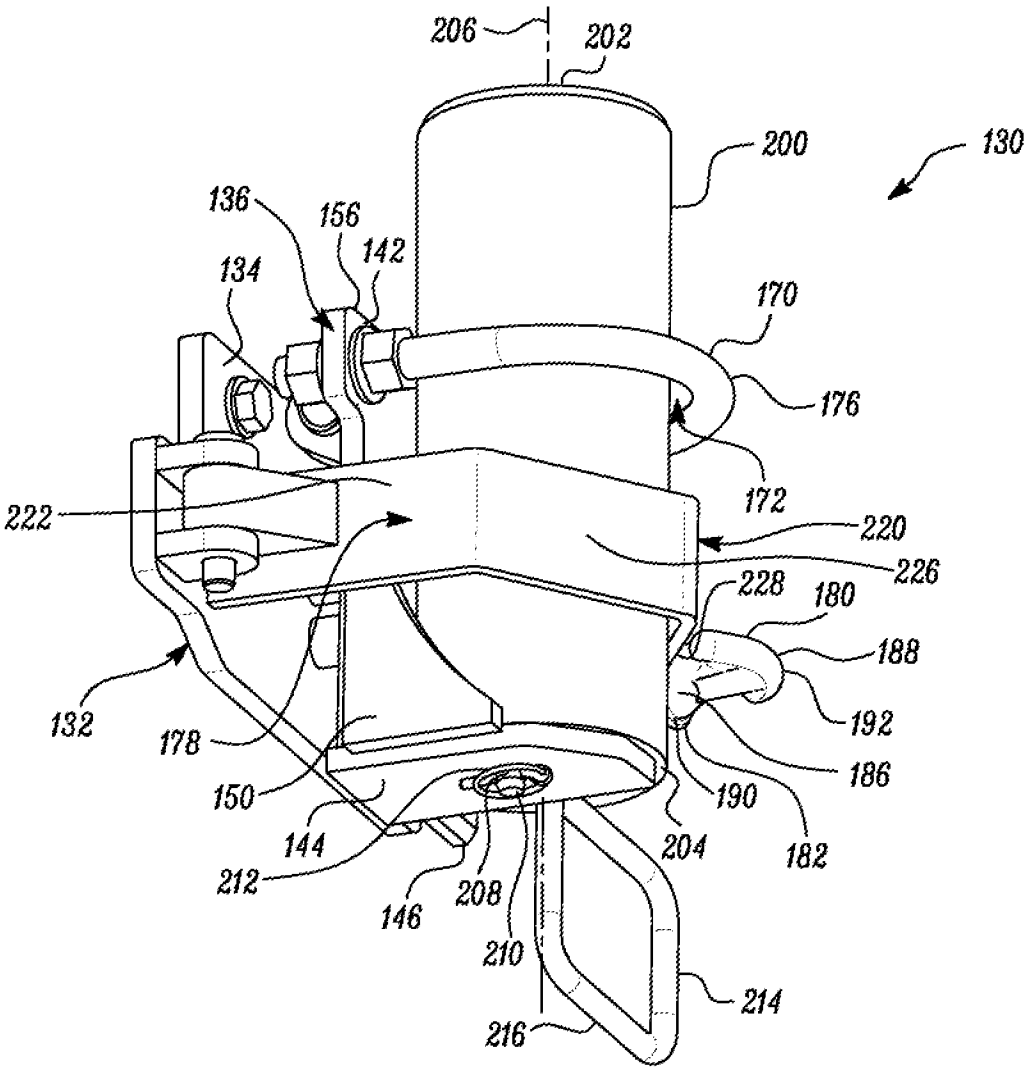
FIG. 5 is a bottom perspective view of the service pin assembly having the tray disposed in the first position, in accordance with an embodiment of the present disclosure.

In an embodiment, best shown in FIG. 3. FIG. 4, and FIG. 6 the strap 178 may include a V-shaped portion 220, a first plate 222 extending from an end of the V-shaped portion 220, and a second plate 224 extending from another end of the V-shaped portion 220. Therefore, the V-shaped portion 220 may be a central portion of the strap 178, and may include a third plate 226 and a fourth plate 228. The fourth plate 228 may be coupled to the third plate 226 and may be disposed at an angle 'A' relative to the third plate 226. The angle 'A' defined between the third plate 226 and the fourth plate 228 may be an acute angle. In the locked position of the strap 178, the strap 178 is engaged with the latch 180, and the V-shaped portion 220 is configured to abut the service pin 200 upon the engagement of the strap 178 with the latch 180. In such a case, both the third plate 226 and the fourth plate 228 may abut the service pin 200. Consequently, a rattling of the service pin 200 may be minimized when the tray 136 is disposed in the first position.

The third plate 226 may be coupled to the first plate 222 and may define an obtuse angle therebetween. Similarly, the fourth plate 228 may be coupled to the second plate 224 and may define an obtuse angle therebetween. The first plate 222 and the second plate 224 may be disposed substantially parallel to each other, and may define a gap 230, having a width 'W', therebetween. The width 'W' of the gap 230 may be selected so as to facilitate a pivotal movement of the strap 178 without interfering with the service pin 200. The strap 178 may be pivotably coupled to the bracket 134 or the frame 104 by pivotally coupling the first plate 222 with the bracket 134 or the frame 104. Further, the hook portion 182 may extend from the second plate 224, and may be coupled to the second plate 224 using fasteners. However, it may be appreciated that the hook portion 182 may be an integral structure of the second plate 224.

In an exemplary implementation, the latch 180 may include a spherical portion 186 disposed proximal to a free end 188 of the latch 180, while another end 189 (shown in FIG. 3) of the latch 180 is pivotally attached with the bracket 134. In the locked position of the strap 178, the spherical portion 186 may contact a seat 190 (shown in FIG. 6) of the hook portion 182 (as shown in FIG. 2 and FIG. 3). The latch 180 may further include a holding structure 192 formed at the free end 188 of the latch 180. The holding structure 192 facilitates a holding and pulling of the latch 180 by an operator for engagement or disengagement of the latch 180 relative to the strap 178. Further, the hook portion 182 may include a cut-out 194 (shown in FIG. 6) to facilitate an abutment of the spherical portion 186 with the seat 190. In an embodiment, the latch 180 includes an elastic member.

Additionally, or optionally, the service pin assembly 130 may include one or more dampers 250 (two shown in FIG. 6) for supporting the tray 136 and damping a motion of the tray 136 towards the bracket 134 or the frame 104 when the tray 136 is located or moved to the first position. The dampers 250 may be attached with the bracket 134 and may extend outwardly of the bracket 134, away from the frame 104. In an exemplary scenario, each damper 250 may include a first cylinder 252 and a second cylinder 254 that may telescopically extend and retract, at least partially, relative to the first cylinder 252. A spring (not shown) may be disposed between the first cylinder 252 and the second cylinder 254 to dampen a telescopic motion of the second cylinder 254 relative to the first cylinder 252 in a longitudinal direction. The second cylinder 254 may be configured to abut the tray 136 to facilitate a dampening of a motion of the tray 136 towards the bracket 134 or the frame 104. In an embodiment, each damper 250 may include a rubberized member that may abut the tray 136 to dampen a motion of the of the tray 136 towards the bracket 134 or the frame 104.

In certain implementations, the bracket 134 may be omitted. In such a case, it may be appreciated that various components, such as the tray 136, the hinge 140, the strap 178, the latch 180, and the dampers 250 of the service pin assembly 130, are directly coupled with the frame 104 of the machine 100 in a manner similar to their attachment with the bracket 134, as has been discussed above.

INDUSTRIAL APPLICABILITY

Servicing of the machine 100 is generally performed after a predefined duration of operation of the machine 100. During servicing, various components of the machine 100 may be inspected and a maintenance activity is performed if one or more components are found faulty. In certain situations, the lift arm 112 of the machine 100 may need to be raised and maintained at a desired height relative to the ground to perform an inspection and/or maintenance of the components. For maintaining the lift arm 112 at the desired height, the service pin assembly 130 is utilized. The service pin assembly 130 facilitates a locking of the lift arm 112 with the frame 104 and prevents a pivotal motion of the lift arm 112 relative to the frame 104, during servicing.

Figure 8:
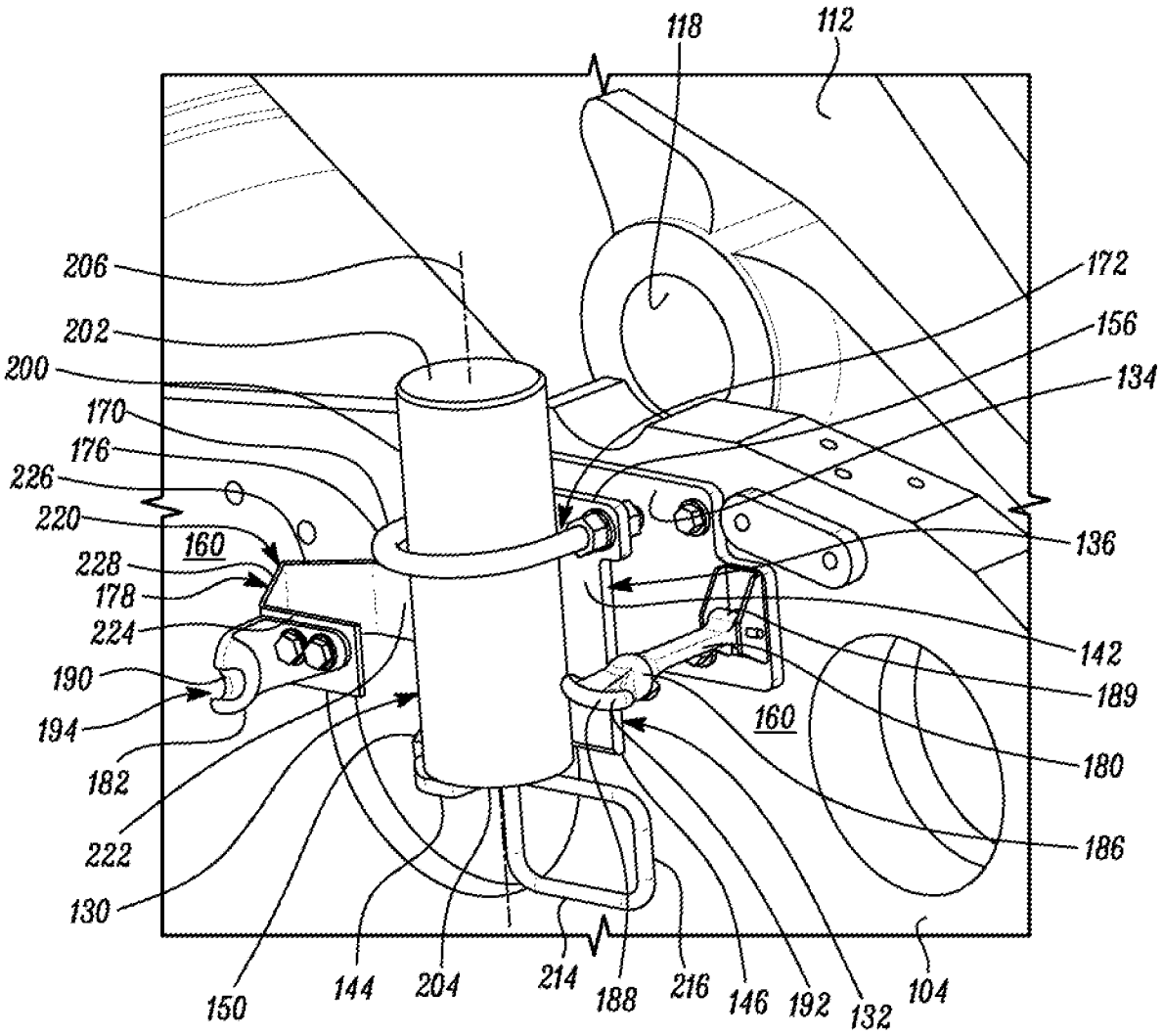
FIGS. 8-11 depict various stages of a process of engaging a service pin of the service pin assembly with the lift arm of the machine, in accordance with an embodiment of the present disclosure.

A process for installing the service pin 200 with the lift arm 112 is described with reference to FIG. 8 to FIG. 11. For performing the servicing operations, an operator may raise the lift arm 112 to the desired height by operating the lift arm actuators 122. Once the lift arm 112 reaches the desired height, further actuation of the lift arm actuators 122 is stopped to maintain the lift arm 112 at the desired height. To lock the lift arm 112 with the frame 104 at the desired height and to prevent a pivotal movement of the lift arm 112, an operator may climb over the machine 100 to operate the service pin assembly 130 and engage the service pin 200 with lift arm 112. For so doing, the operator, at first, disengages the latch 180 from the strap 178 and thereby move the strap 178 from the locking position to the unlocked position, as shown in FIG. 8. For disengaging the latch 180 from the strap 178, the operator may pull the latch 180 by holding and pulling the holding structure 192, causing a disengagement of the spherical portion 186 from the seat 190 of the hook portion 182. Thereafter, the latch 180 is moved through the cut-out 194 to facilitate a complete disengagement of the latch 180 from the strap 178. Upon disengaging the strap 178 from the latch 180, the operator moves the strap 178 to the unlocked position.

Figure 9:
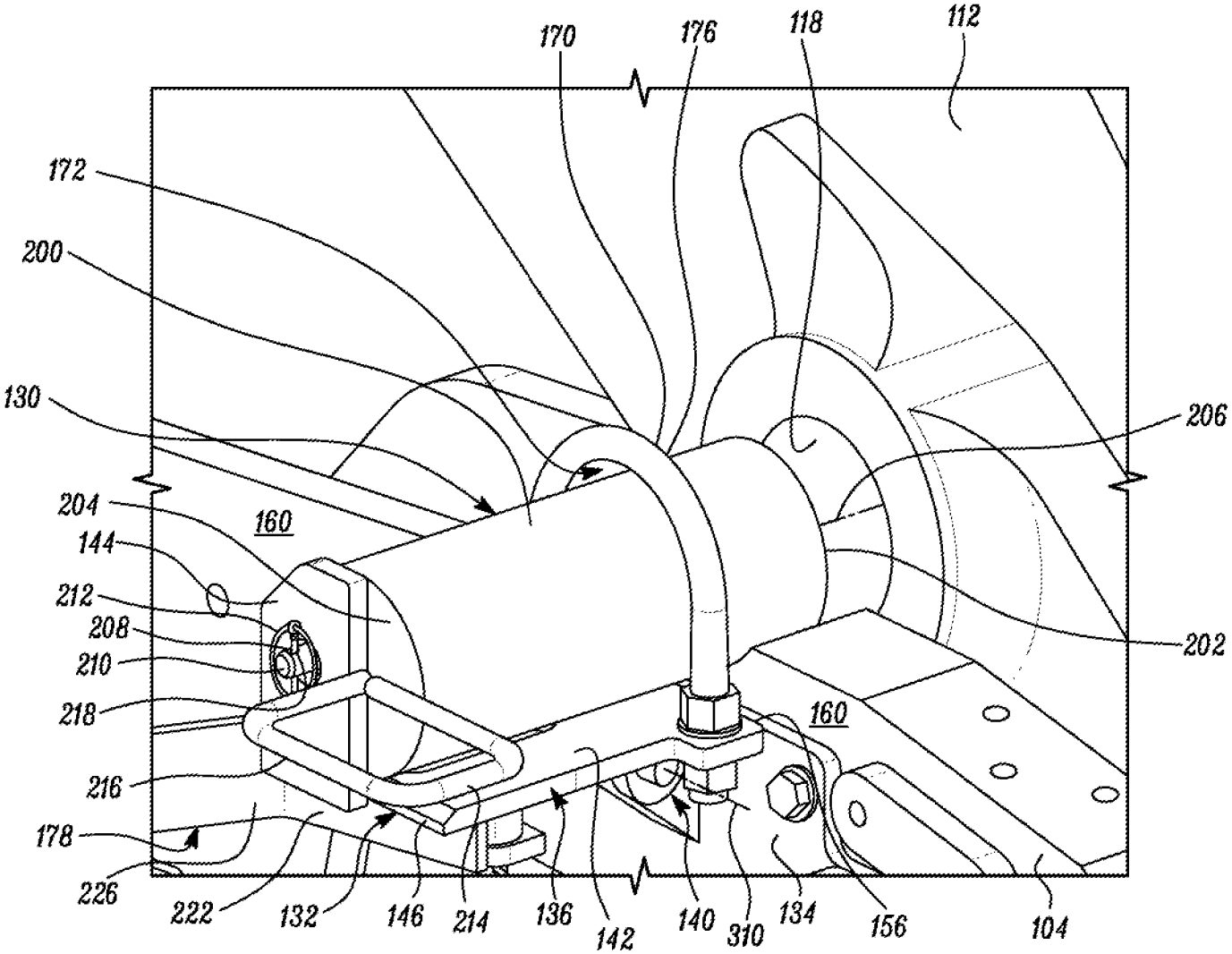
Figure 10:
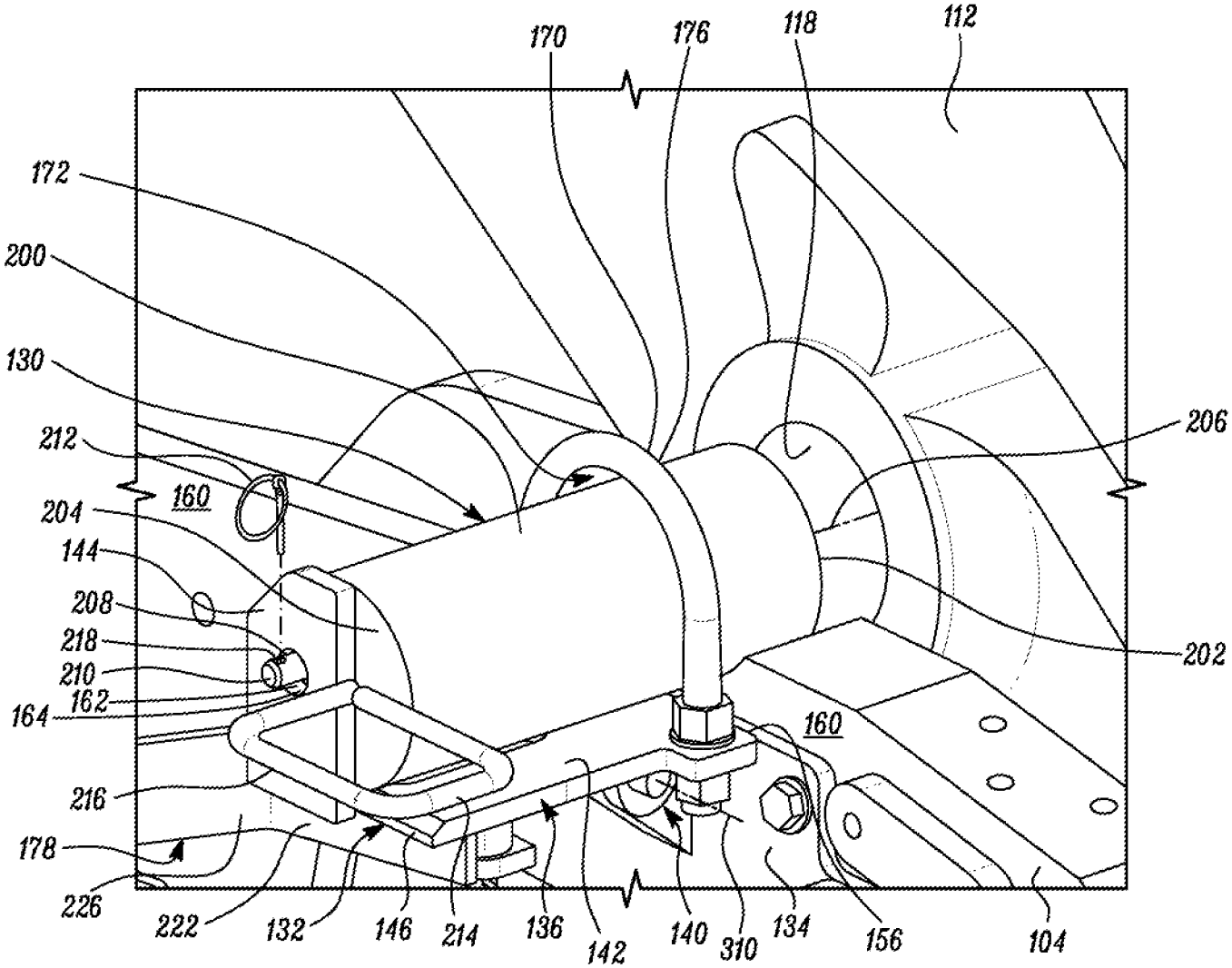

Subsequently, the operator may hold the handle 216 of the service pin 200 and move the tray 136 from the first position to the second position (shown in FIG. 9). It may be noted that the first center of gravity 300 the second center of gravity 302 may be aligned with the hinge 140, which makes the force (and thus the effort) needed to lift the service pin 200 relatively minimal. As seen from the FIG. 9, in the second position, the base 142 of the tray 136 may be disposed substantially parallel to a ground surface. Upon moving the tray 136 to the second position, the operator may decouple the service pin 200 from the tray 136 (i.e., the wall 144 of the tray 136) by disengaging the fastening structure 208 (i.e., the stud 210) from the coupling structure 162 (i.e., the opening 164) by removing the clip pin 212, as shown in FIG. 10.

Once the service pin 200 is disengaged from the wall 144 of the tray 136, the operator may push the service pin 200 towards the frame 104, and thereby insert a portion of the service pin 200 inside the hole 118 of the lift arm 112 (as shown in FIG. 11). In so doing, the service pin 200 is pushed from the stored position to the extended position. At the extended position, the stopper 214 (the handle 216) may abut the retention structure 170, and therefore, a further movement of the service pin 200 towards the frame 104 is restricted. Further, an abutment of the stopper 214 (the handle 216) with the retention structure 170 may indicate a positive engagement of the service pin 200 with the lift arm 112 and the frame 104. In this manner, the service pin assembly 130 may be operated by the operator using a single hand, and, accordingly, the operator may utilize the other hand to support himself on the machine 100.

Further, after servicing the machine 100, to disengage the lift arm 112 from the frame 104, the operator may again climb upon the machine 100, and pulls the service pin 200 out of the hole 118 towards the wall 144 of the tray 136, thereby moving the service pin 200 from the extended position to the stored position. In doing so, the service pin 200 is removed from the hole 118 of the lift arm 112, thereby disengaging the service pin 200 from the lift arm 112. In so doing, the pivotal motion of the lift arm 112 relative to the frame 104 is enabled. Subsequently, in the stored position, the operator may engage the coupling structure 162 with the fastening structure 208 to prevent the sliding movement of the service pin 200 relative to the base 142 of the tray 136. In an exemplary embodiment, the service pin 200 is engaged with the wall 144 of tray 136 by inserting the stud 210 through the opening 164 and inserting the clip pin 212 into an opening 218 (best shown in FIG. 10 and FIG. 1) defined into the stud 210.

Subsequently, the operator holds the handle 216 and applies force on the handle 216 to pivot the tray 136 along with the service pin 200 to the first position (or, in some cases, the tray 136 along with the service pin 200 may be guided under gravity to the first position). In the first position, the base 142 of the tray 136 contacts the dampers 250 which dampens further movement of the tray 136 towards the frame 104. Thereafter, the operator may move the strap 178 to the locked position and may engage the latch 180 with the strap 178 so that the strap 178 may enwrap the service pin 200. To engage the latch 180 with the strap 178, the operator holds the holding structure 192 of the latch 180, pulls the latch 180, inserts the latch 180 through the cut-out 194, and engages the spherical portion 186 of the latch 180 with the seat 190. As the latch 180 may include an elastic member, the pulling of latch 180 causes an extension of the latch 180 developing a pulling force toward the frame. As a result, when the latch 180 is released by the operator after engagement with the strap 178, the latch 180 pulls the strap 178 towards the service pin 200 due to the elasticity of the elastic member, thereby facilitating a retention of the tray 136 in the first position. Also, the strap 178 helps in reducing an oscillation of the tray 136, while the machine 100 is moving or performing any operation.

What is claimed is:

1. A service pin assembly for a machine, the service pin assembly comprising:
- a service pin; and
- a tray retaining the service pin and attachable to a frame of the machine, the tray being pivotable relative to the frame between a first position and a second position, wherein
  - in the first position, the tray facilitates a storage of the service pin with the machine, and
  - in the second position, the tray facilitates an engagement of the service pin with a lift arm of the machine and the frame to restrict a relative movement between the frame and the lift arm.

2. The service pin assembly of claim 1, wherein the service pin is movable between a stored position and an extended position relative to the tray, wherein
- in the first position, the service pin is disposed at the stored position and is coupled to the tray, and
- in the second position, the service pin is configured to be slidably moved from the stored position to the extended position for engaging the service pin with the lift arm and the frame.

3. The service pin assembly of claim 1 further including a retention structure coupled to the tray to facilitate a retention of the service pin with the tray.

4. The service pin assembly of claim 3, wherein the retention structure includes a U-shaped profile defining an opening with the tray for receiving the service pin.

5. The service pin assembly of claim 3, wherein the service pin includes a stopper configured to abut the frame or the retention structure to stop a sliding movement of the service pin.

6. The service pin assembly of claim 1, wherein the tray includes a base for supporting the service pin in the second position, and a wall extending substantially perpendicular to the base for supporting the service pin in the first position, wherein the service pin is coupled to the wall in the first position.

7. The service pin assembly of claim 1 further comprising a strap pivotably coupled to the frame, and a latch configured to engage with the strap to retain the tray in the first position.

8. The service pin assembly of claim 7, wherein the strap includes a V-shaped portion configured to abut the service pin upon an engagement of the strap with the latch.

9. The service pin assembly of claim 1, wherein the tray includes a coupling structure, and the service pin includes a fastening structure, wherein the fastening structure is engaged with the coupling structure for attaching the service pin with the tray.

10. The service pin assembly of claim 9, wherein the fastening structure includes a stud and the coupling structure includes an opening for receiving the stud.

11. The service pin assembly of claim 1 further including a hinge to pivotably couple the tray to the frame, the service pin defines a first center of gravity and the tray defines a second center of gravity, wherein each of the first center of gravity and the second center of gravity is proximal to the hinge.

12. A machine, comprising:

a frame;

a lift arm coupled to the frame and configured to pivot relative to the frame;

a service pin configured to engage the frame with the lift arm to restrict a relative movement between the frame and the lift arm; and a tray retaining the service pin and coupled to the frame of the machine, the tray being pivotable relative to the frame between a first position and a second position, wherein in the first position, the tray facilitates a storage of the service pin with the machine, and in the second position, the tray facilitates an engagement of the service pin with the lift arm of the machine and the frame.

13. The machine of claim 12, wherein the service pin is movable between a stored position and an extended position relative to the tray, wherein in the first position, the service pin is disposed at the stored position and is coupled to the tray, and in the second position, the service pin is configured to be slidably moved from the stored position to the extended position for engaging the service pin with the lift arm and the frame.

14. The machine of claim 12 further including a retention structure coupled to the tray to facilitate a retention of the service pin with the tray.

15. The machine of claim 14, wherein the retention structure includes a U-shaped profile defining an opening with the tray for receiving the service pin.

16. The machine of claim 14, wherein the service pin includes a stopper configured to abut the frame or the retention structure to stop a sliding movement of the service pin.

17. The machine of claim 12, wherein the tray includes a base for supporting the service pin in the second position, and a wall extending substantially perpendicular to the base for supporting the service pin in the first position, wherein the service pin is coupled to the wall in the first position.

18. The machine of claim 12 further comprising a strap pivotably coupled to the frame and including a V-shaped portion, and a latch configured to engage with the strap to retain the tray in the first position, wherein the V-shaped portion abuts the service pin when the latch is engaged with the strap.

19. The machine of claim 12, wherein the tray includes a coupling structure, and the service pin includes a fastening structure, wherein the fastening structure is engaged with the coupling structure for attaching the service pin with the tray.

20. The machine of claim 12 further including a hinge to pivotably couple the tray to the frame, the service pin defines a first center of gravity and the tray defines a second center of gravity, wherein each of the first center of gravity and the second center of gravity is proximal to the hinge.

* * * * *